US012208341B2

(12) United States Patent
Iwawaki

(10) Patent No.: US 12,208,341 B2
(45) Date of Patent: Jan. 28, 2025

(54) TOY

(71) Applicant: BANDAI CO., LTD., Tokyo (JP)

(72) Inventor: Yumi Iwawaki, Tokyo (JP)

(73) Assignee: BANDAI CO., LTD., Tokyo (JP)

( * ) Notice: Subject to any disclaimer, the term of this patent is extended or adjusted under 35 U.S.C. 154(b) by 356 days.

(21) Appl. No.: 17/838,209

(22) Filed: Jun. 11, 2022

(65) Prior Publication Data

US 2022/0401848 A1 Dec. 22, 2022

(30) Foreign Application Priority Data

Jun. 16, 2021 (JP) ..... 2021-099875

(51) Int. Cl.
*A63H 33/00* (2006.01)
*A63H 3/50* (2006.01)

(52) U.S. Cl.
CPC ..... *A63H 33/003* (2013.01); *A63H 3/50* (2013.01)

(58) Field of Classification Search
CPC ..... A63H 33/00; A63H 33/003; A63H 3/005; A63H 3/50
USPC ..... 446/71, 73, 75, 376; 220/4.25
See application file for complete search history.

(56) References Cited

U.S. PATENT DOCUMENTS 2,858,955 A * 11/1958 Kroenert ..... B65D 43/0212 220/788
2,975,547 A * 3/1961 Greve ..... A63B 67/16 426/104
2,996,208 A * 8/1961 Schroeder ..... B65D 81/36 215/377
4,103,774 A * 8/1978 Shingyouchi ..... B65D 81/361 446/124
4,106,657 A * 8/1978 Dogliotti ..... A23G 3/545 215/10
4,863,054 A * 9/1989 Capetta ..... B65D 43/162 220/4.23
4,964,831 A * 10/1990 Wolff ..... A63H 3/50 446/268

(Continued)

FOREIGN PATENT DOCUMENTS

JP H07-148358 A 6/1995
JP 2003-275476 A 9/2003

(Continued)

OTHER PUBLICATIONS

Japan Patent Office, Office Action for Japanese Patent Application No. 2021-099875, Feb. 1, 2022.

*Primary Examiner* — Alexander R Niconovich

(57) ABSTRACT

A toy transformable between a first form and a second form includes a first outer shell part and a second outer shell part configured to be coupled to the first outer shell part. The first outer shell part and the second outer shell part are configured to form different configurations in the first form and the second form, depending on coupling between an end of the first outer shell part and an end of the second outer shell part. Transformation is made between the first and second forms by selecting coupling in which coupling ends on opening sides of the respective first and second outer shell parts face each other or coupling of a coupling end opposite (facing in an opposite direction from) the coupling end on the opening side of the second outer shell part to the coupling end on the opening side of the first outer shell part.

11 Claims, 18 Drawing Sheets

(56) References Cited

U.S. PATENT DOCUMENTS 5,035,324 A * 7/1991 Bertrand ..... B65D 81/361 206/508
5,224,894 A * 7/1993 Nelson ..... A63H 33/004 446/310
5,287,979 A * 2/1994 Bourgeois ..... A47G 19/24 220/523
5,676,251 A * 10/1997 Credle, Jr. ..... B65D 81/361 206/541
6,209,725 B1 * 4/2001 Chen ..... B65D 25/02 206/508
6,296,541 B1 * 10/2001 Bezalel ..... B65D 81/361 220/23.6
7,285,034 B2 * 10/2007 Kay ..... A63H 3/52 446/73
7,527,542 B2 * 5/2009 Collins ..... A63F 7/045 40/406
7,618,302 B2 * 11/2009 Collins ..... A63H 18/02 446/168
7,654,531 B2 * 2/2010 Collins ..... A63F 3/0023 273/287
8,210,538 B2 * 7/2012 Shoemaker, Jr. ... G07F 17/3216 273/447
9,694,295 B2 * 7/2017 Walterscheid ..... A63H 3/003
10,421,028 B2 * 9/2019 Choi ..... A63H 17/02
11,173,412 B2 * 11/2021 Hansen ..... A63H 33/086
11,291,279 B2 * 4/2022 Liu ..... A45C 13/36
12,076,658 B2 * 9/2024 Iwawaki ..... A63H 3/52
2004/0262310 A1 * 12/2004 Silk ..... B65D 43/0229 220/293
2005/0142980 A1 * 6/2005 Rivero ..... B65D 81/365 446/75
2007/0086607 A1 * 4/2007 Holsheimer ..... A63H 33/086 381/172
2018/0311593 A1 * 11/2018 Choi ..... A63H 33/003
2022/0315271 A1 * 10/2022 Hirohashi ..... B65D 43/162
2024/0216826 A1 * 7/2024 Mitsuishi ..... A63H 33/00

FOREIGN PATENT DOCUMENTS

JP 2005-342124 A 12/2005
JP 2021-083495 A 6/2021
WO 2019/012843 A1 1/2019

* cited by examiner

TOY

CROSS-REFERENCE TO RELATED APPLICATION

The present application claims priority under 35 U.S.C. § 119 to Japanese Patent Application No. 2021-099875, filed Jun. 16, 2021, the contents of which are incorporated herein by reference in their entirety.

BACKGROUND

Technical Field

The present invention relates to a toy.

Description of the Related Art

Conventionally, there have been capsule toys which are sold in automatic vending machines and in which dolls or other items are stored inside capsules. For example, Japanese Patent Application Publication No. Hei 07-148358 (hereinafter referred to as Patent Document 1) discloses a capsule toy including a capsule constituted by first and second capsule constituent members. Inside the capsule, parts for assembling the toy are stored. A predetermined number of cut-outs are formed in a cut edge of the first capsule constituent member, and fitting some or all of the parts into these cut-outs forms the toy. Further, in order to prevent the separation of the capsule, a predetermined number of ribs are provided on the inner wall of the second capsule constituent member to pinch the cut edge of the first capsule constituent member.

Patent Document 1 discloses a structure in which the capsule itself is used as a part of the toy. However, when the capsule is used as part of the toy, the capsule remains in a spherical shape which is the same shape as at the time of sale. Therefore, the shape of the toy is dependent on the spherical shape of the capsule, making it difficult to maintain the original character image. Depending on the character, the shape of the capsule significantly changes the shape of the character. This poses a problem in the quality of the character itself, making it difficult to maintain the interesting part of the character. Further, since the overall shape of the toy itself is basically spherical, the placement and display states of the toy are problematically unstable and insecure.

An object of the present invention is to provide a stable, easy-to-display, and highly interesting toy that can maintain the quality of a character.

BRIEF SUMMARY

A toy according to an embodiment of the present invention is transformable between a first form and a second form and includes: a first outer shell part; and a second outer shell part configured to be coupled to the first outer shell part, in which the first outer shell part and the second outer shell part are configured to form different configurations in the first form and the second form, depending on coupling between an end of the first outer shell part and an end of the second outer shell part.

According to an embodiment of the present invention, a highly interesting toy can be provided.

BRIEF DESCRIPTION OF THE DRAWINGS

FIG. 13A is a perspective view illustrating the front surface side of a third outer shell part illustrated in FIG. 12 while

DETAILED DESCRIPTION

First Embodiment

Figure 1:
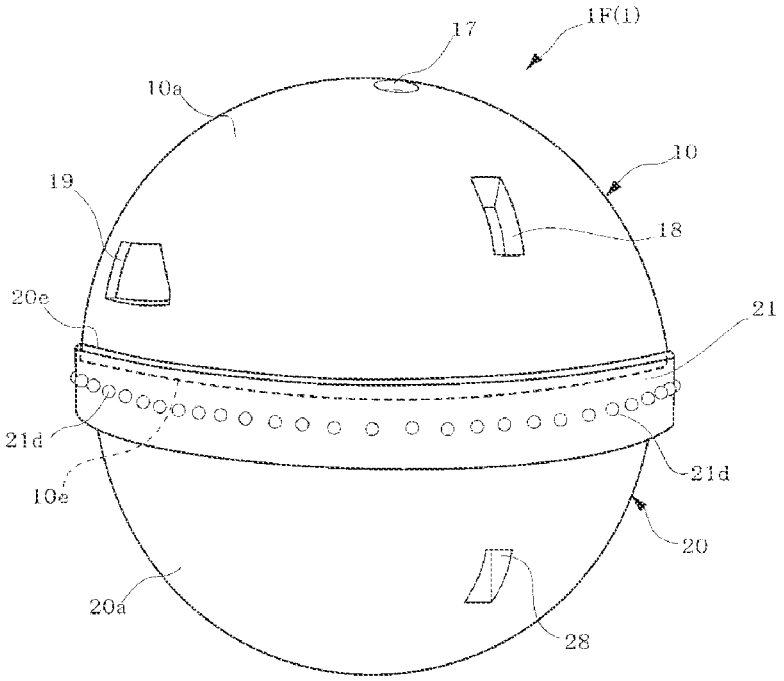
FIG. 1 is a perspective view illustrating a first form of a toy according to a first embodiment of the present invention.
Figure 2:
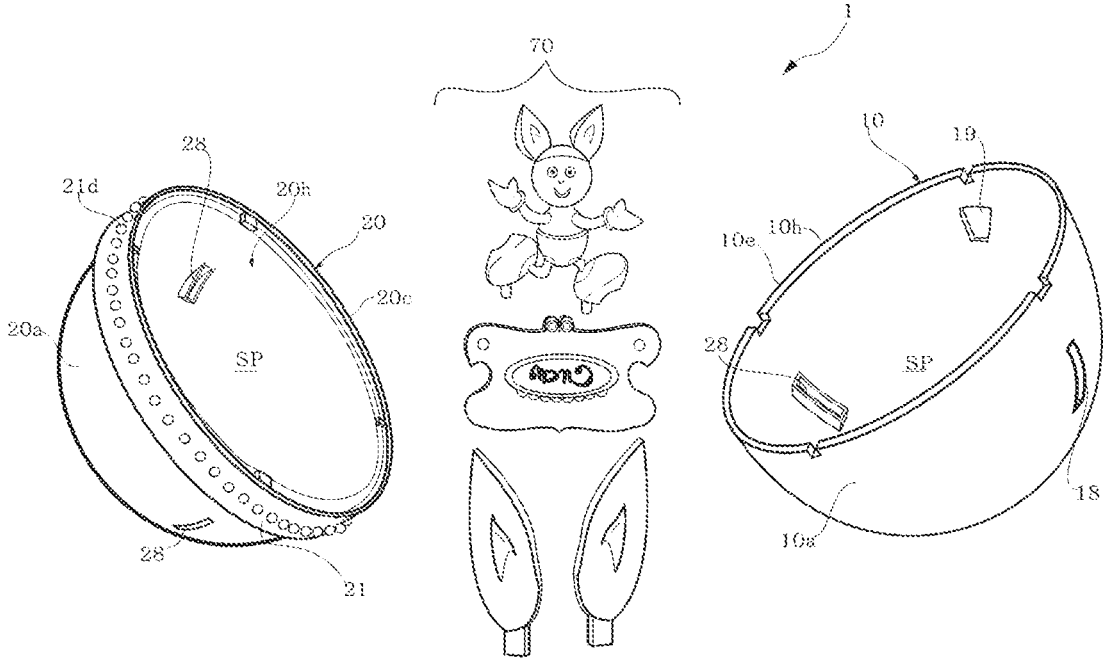
FIG. 2 is a perspective view illustrating the state in which the toy illustrated in FIG. 1 is disassembled.

A toy 1 according to a first embodiment of the present invention will be described with reference to FIGS. 1 to 10. FIG. 1 is a perspective view illustrating a first form 1F of the toy 1. FIG. 2 is a perspective view illustrating the state in which the toy 1 is disassembled from the first form 1F of the toy 1.

As illustrated in FIG. 1, the toy 1 in the first form 1F includes a first outer shell part 10 and a second outer shell part 20 and has a substantially spherical shape in appearance. As illustrated in FIG. 2, the first outer shell part 10 and the second outer shell part 20 have, for example, hemispherical main bodies 10*a* and 20*a*, respectively. Each of the main bodies 10*a* and 20*a* has a hemispherical space SP thereinside. An opening edge 10*e*, which forms an opening 10*h* of the main body 10*a*, and an opening edge 20*e*, which forms an opening 20*h* of the main body 20*a*, are configured such that they can be coupled to each other. Therefore, in the state in which the first form 1F is assembled, a spherical space SP is formed inside.

The first outer shell part 10 and the second outer shell part 20 are formed of, for example, synthetic resin and have rigidity when necessary. In the spherical-shaped first form 1F illustrated in FIG. 1, the toy 1 has an easy-to-roll, rollable configuration and therefore can be supplied and sold from a goods supply device. Further, the interior space SP in the first form 1F houses a sub-part 70, which resembles, for example, a character as illustrated in FIG. 2.

The toy 1 can also be transformed into a second form 2F (see FIG. 10), which is different from the first form 1F. For example, the second form 2F is a form in which the sub-part 70 that has been housed inside in the first form 1F is displayed. The toy 1 can be transformed from the first form 1F into the second form 2F, or vice versa, by changing the way of coupling between the edges (opening edges 10*e* and 20*e*) of the first outer shell part 10 and the second outer shell part 20 (details will be described later). To allow the sub-part 70 to be displayed in the second form 2F, the first outer shell part 10 and the second outer shell part 20 have attachment holes (circular holes 17, rectangular holes 18 and 28, and a trapezoidal hole 19).

Figure 3:
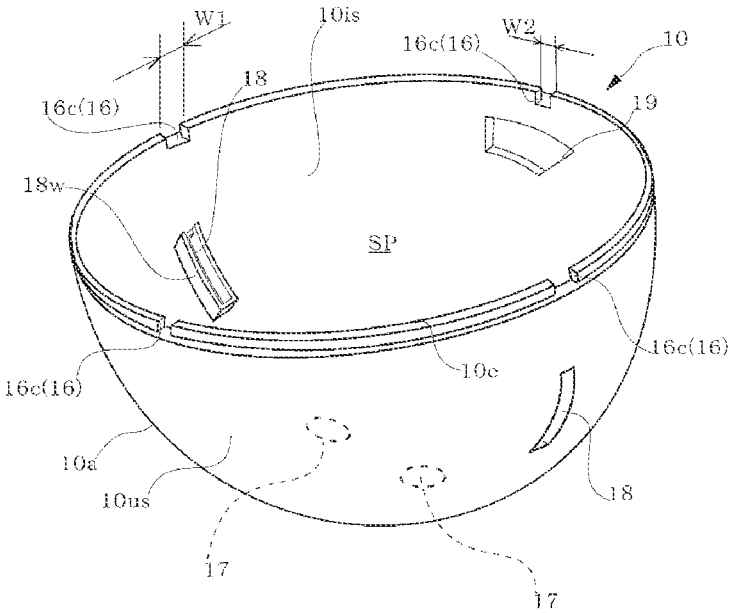
FIG. 3 is an enlarged perspective view as viewed from one end of a first outer shell part illustrated in FIG. 2.

FIG. 3 is an enlarged perspective view as viewed from one end (opening edge 10*e*) of the first outer shell part 10 illustrated in FIG. 2. As illustrated in FIG. 3, the first outer shell part 10 includes the hemispherical main body 10*a* having one end at which the opening edge 10*e* having a circular shape is formed. Further, for example, the first outer shell part 10 includes two circular holes 17, the rectangular holes 18, and the trapezoidal hole 19. Specifically, the two circular holes 17 are provided at the other end of the main body 10*a*. Each rectangular hole 18 is provided between the corresponding circular hole 17 and the opening edge 10*e*. The trapezoidal hole 19 is provided at a position approximately 90 degrees away from the rectangular holes 18 along the opening edge 10*e*. Each rectangular hole 18 is a hole that penetrates the main body 10*a* and that is surrounded by a hole surrounding wall 18*w*, which protrudes into the space SP from an inner surface 10*is*, for example.

The opening edge 10*e* has a stepped structure in which the opening edge 10*e* on an outer surface 10*us* side of the main body 10*a* is recessed and is slightly thin. Further, four cut-out positioning recesses 16*c* are provided at 90° intervals along the circumferential direction of the opening edge 10*e*. These positioning recesses 16*c* constitute positioning portions 16, together with positioning protrusions 16*d* of the second outer shell part 20, which will be described later. The positioning recesses 16*c* are formed to have two different cut-out widths. Specifically, each of the positioning recesses 16*c* has either a cut-out width W1 or a cut-out width W2 different from the cut-out width W1 (W1>W2). With this configuration, the positioning recesses 16*c* and the positioning protrusions 16*d* of the second outer shell part 20 help determine the orientation of the combination.

Figure 4:
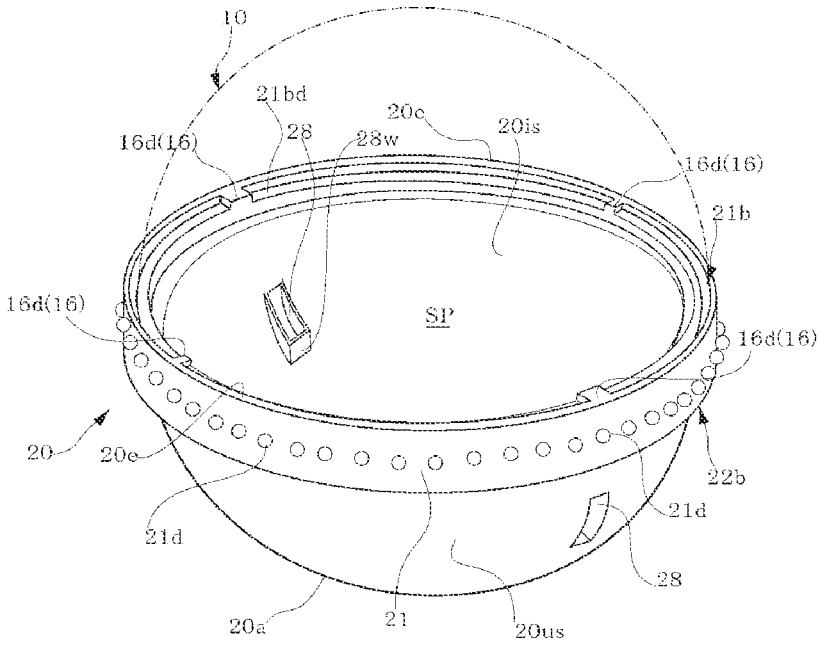
FIG. 4 is an enlarged perspective view as viewed from one end of a second outer shell part illustrated in FIG. 2.
Figure 5:
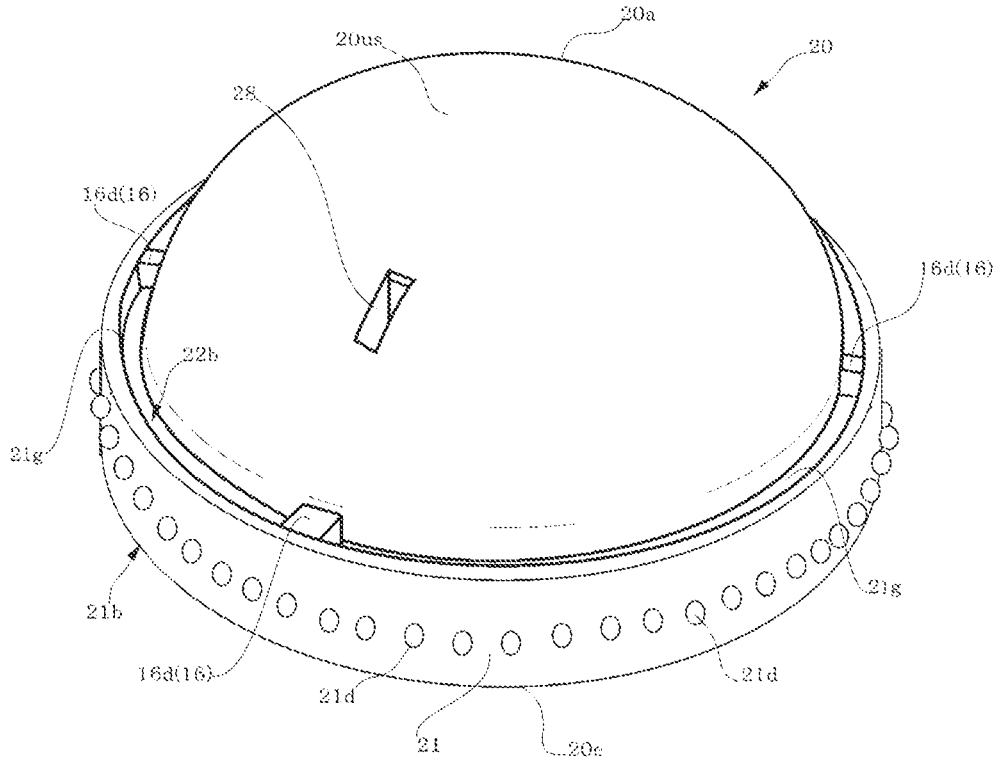
FIG. 5 is an enlarged perspective view as viewed from the other end of the second outer shell part illustrated in FIG. 4.

FIG. 4 is an enlarged perspective view as viewed from one end (opening edge 20*e*) of the second outer shell part 20 illustrated in FIG. 2. FIG. 5 is an enlarged perspective view as viewed from the other end of the second outer shell part 20 illustrated in FIG. 4. As illustrated in FIG. 4, the second outer shell part 20 includes the hemispherical main body 20*a* having one end at which the opening edge 20*e* having a circular shape is formed. Two rectangular holes 28, which are not through holes, are provided in the main body 20*a* at positions corresponding to the positions of the rectangular holes 18. As with the rectangular holes 18, each rectangular hole 28 is provided with a hole surrounding wall 28*w*, which protrudes into the space SP from an inner surface 20*is*.

The opening edge 20*e* is formed in an overhanging portion 21, which outwardly protrudes from an outer surface 20*us* of the main body 20*a*. The inner side of the overhanging portion 21 has, for example, a two stepped structure with a gradually decreasing diameter so as to be connected to the inner surface 20*is*. In other words, the opening edge 20*e* has a larger diameter than that of the main body 20*a* and can be coupled to the opening edge 10*e* of the first outer shell part 10, which is larger in size than the main body 20*a*. The opening edge 20*e* constitutes a first coupling portion 21*b* in the first form 1F. Note that the opening edge 20*e* includes the positioning protrusions 16*d*. The positioning protrusions 16*d* are rectangular protrusions that protrude from a step 21*bd*, which is to be in contact with the opening edge 10*e* of the first outer shell part 10 in the first form 1F, to the height of the opening edge 20*e*. The positioning protrusions 16*d* are configured to be fitted into the respective positioning recesses 16*c* for coupling and positioning with respect to the first outer shell part 10.

As illustrated in FIG. 5, as viewed from the outer surface 20*us*, the overhanging portion 21 protrudes at a certain distance from the outer surface 20*us* of the second outer shell part 20. Accordingly, a coupling groove 21*g* is formed between the outer surface 20*us* and the overhanging portion 21. Further, the coupling groove 21*g* constitutes a second coupling portion 22*b*, which is coupled to the opening edge 10*e* of the first outer shell part 10 in the second form 2F. The fact that the second outer shell part 20 can be coupled to the opening edge 10*e* of the first outer shell part 10 at the second coupling portion 22*b* in the second form 2F means that the outer surface 20*us* of the second outer shell part 20 is sized that it can fit within the inner surface 10*is* of the first outer shell part 10. Note that the positioning protrusions 16*d* are also provided in the coupling groove 21*g* and protrude from the groove bottom surface. Further, a large number of protrusions 21*d* are provided over the entire outer circumferential surface of the overhanging portion 21.

Figure 6:
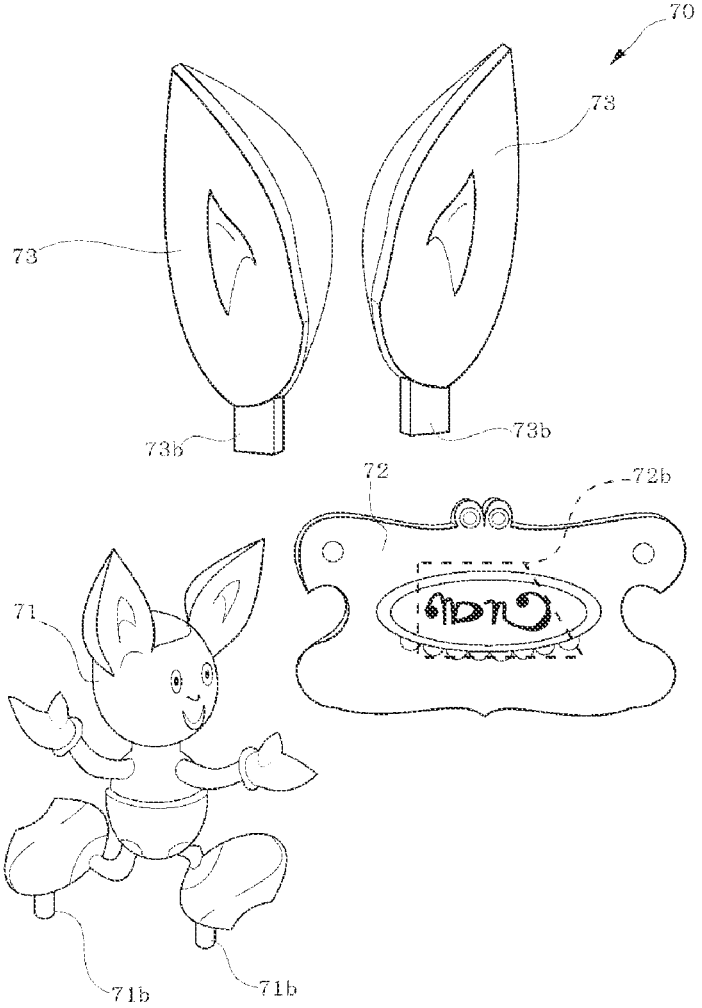
FIG. 6 is a perspective view illustrating an example of a sub-part according to the first embodiment.

The assembly of the toy 1 when transforming from the first form 1F into the second form 2F will be described below with reference to FIGS. 6 to 10. FIG. 6 is a perspective view illustrating an example of the sub-part 70. The sub-part 70 includes a figure part 71, an emblem part 72, and a pair of ear parts 73. The figure part 71 is a sub-part of the first type and has a shape of a particular character. The emblem part 72 is a sub-part of the second type and has a plate shape. The pair of ear parts 73 are sub-parts of the third type and are, for example, enlarged ears that are a characteristic part of the character. The figure part 71 includes a pair of cylindrical attachment protrusions 71*b*, which protrude from legs of a main body of the figure part 71. The emblem part 72 includes an attachment protrusion 72*b* on its back side. The attachment protrusion 72*b* has a trapezoidal shape in cross section. The pair of ear parts 73 include attachment protrusions 73*b*, which protrude from the lower ends of the respective main bodies of the ear parts 73 and have a rectangular shape in cross section.

Figure 7:
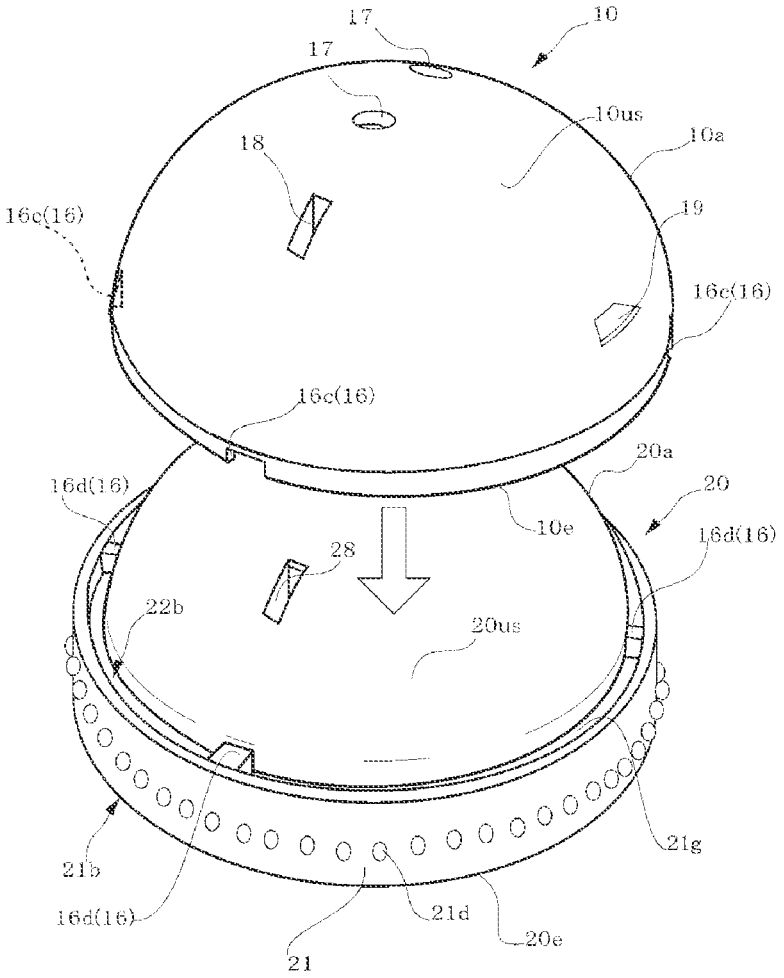
FIG. 7 is a perspective view illustrating the first outer shell part being combined with the other end of the second outer shell part.
Figure 8:
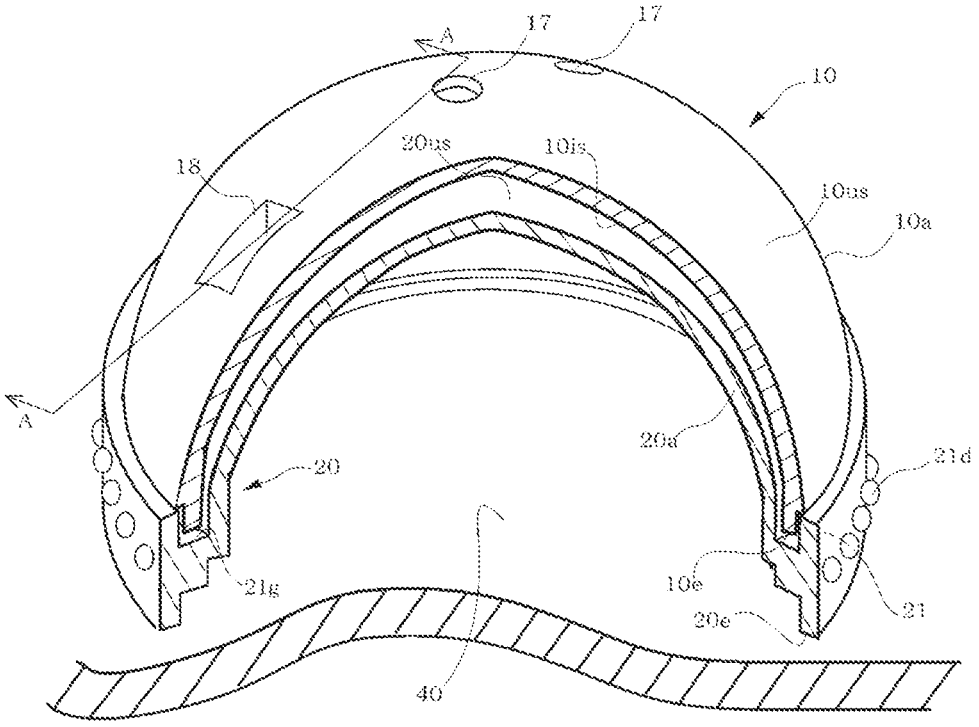
FIG. 8 is a partially broken perspective view of the state in which the first outer shell part is combined with the other end of the second outer shell part.

FIG. 7 is a perspective view illustrating the first outer shell part 10 being combined with the other end (outer surface side) of the second outer shell part 20. FIG. 8 is a partially broken perspective view of the state in which the first outer shell part 10 is combined with the other end (outer surface side) of the second outer shell part 20. Specifically, after the first outer shell part 10 and the second outer shell part 20 are detached from the state of the first form 1F, the second outer shell part 20 is inverted so as to change its facing surface that faces the first outer shell part 10 as illustrated in FIG. 7. In this state, the opening edge 10*e* of the first outer shell part 10 is fitted to the second coupling portion 22*b* of the second outer shell part 20. At this time, the orientation of the combination is determined by the positioning portions 16 (the positioning recesses 16*c* and the positioning protrusions 16*d*). By this positioning, the positions of the rectangular holes 18 and 28 correspond to each other in the vertical direction, and the first outer shell part 10 and the second outer shell part 20 are combined with each other as illustrated in FIG. 8.

In the state in which the first outer shell part 10 and the second outer shell part 20 are combined with each other, as illustrated in FIG. 8, the inner surface 10*is* of the first outer shell part 10 and the outer surface 20*us* of the second outer shell part 20 other than the overhanging portion 21 are combined with each other so as to closely face each other with a predetermined gap therebetween. Further, in the second form 2F, the overhanging portion 21 functions as a placement portion that can be placed on a placement surface 40 with the opening edge 20*e* in contact with the placement surface 40. Moreover, the overhanging portion 21 functions as a supporting portion that supports the lower side of the first outer shell part 10.

Figure 9:
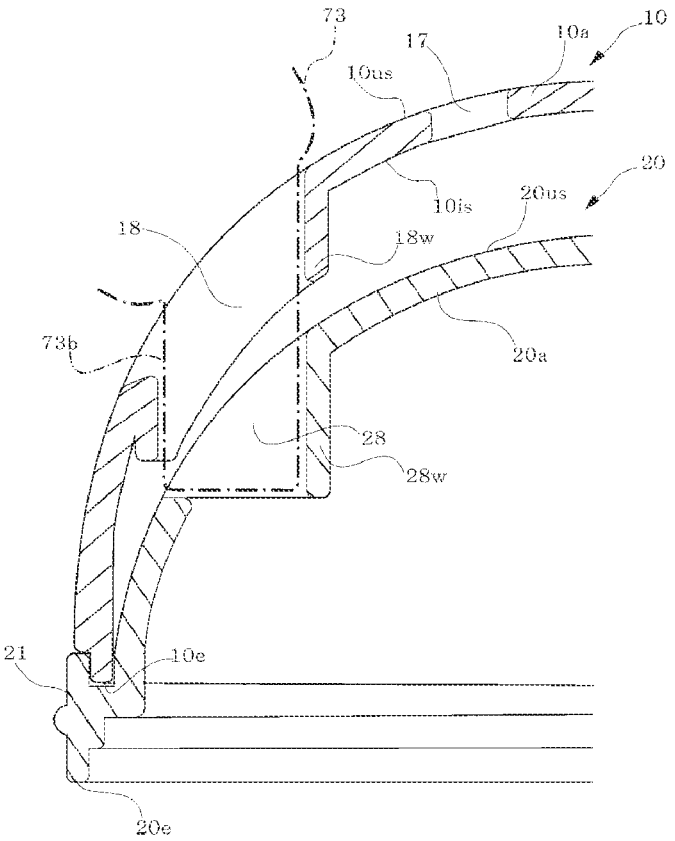
FIG. 9 is a sectional arrow view of a portion taken along line A-A illustrated of FIG. 8.

FIG. 9 is a sectional arrow view of a portion taken along line A-A of FIG. 8. As illustrated in FIG. 9, the rectangular hole 18 of the first outer shell part 10 and the rectangular hole 28 of the second outer shell part 20 are positioned and combined with each other, constituting a hole that communicates in the vertical direction. Therefore, as illustrated in FIG. 9, with the ear part 73 (denoted by a dashed-dotted line) attached, its attachment protrusion 73*b* penetrates the main body 10*a* of the first outer shell part 10, reaching the second outer shell part 20. Accordingly, the ear part 73 is fixed by both the first outer shell part 10 and the second outer shell part 20.

Figure 10:
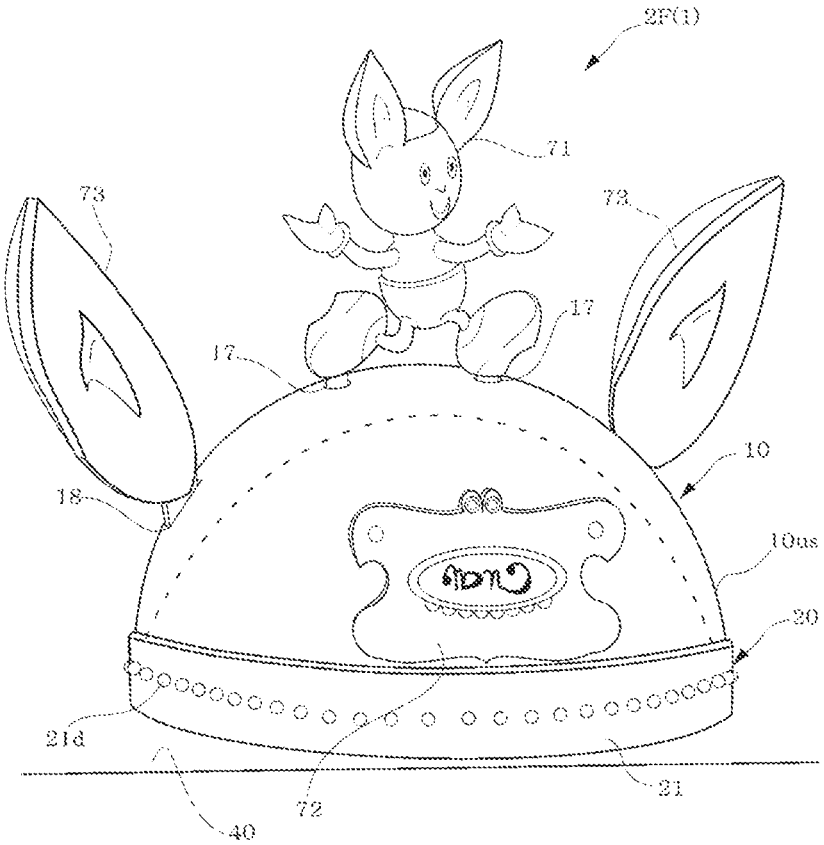
FIG. 10 is a perspective view illustrating a second form of the toy according to the first embodiment.

FIG. 10 is a perspective view illustrating the second form 2F of the toy 1. As illustrated in FIG. 10, the figure part 71 is attached to the circular holes 17, the emblem part 72 is attached to the trapezoidal hole 19, and the ear parts 73 are attached to the rectangular holes 18. In this way, the figure part 71, the emblem part 72, and the ear parts 73 are displayed on the outer surface 10*us* of the first outer shell part 10. For example, the sizes of the pair of circular holes 17 are differentiated from each other so that the orientation of the attachment of the figure part 71 is determined. Further, because of the shape of the trapezoidal hole 19, the emblem part 72 can be attached to the trapezoidal hole 19 in the correct orientation without mistakenly being attached thereto upside down.

As described above, in the toy 1 according to the present embodiment, either coupling in which the first outer shell part 10 and the second outer shell part 20 are coupled to each other such that their opening sides face each other or coupling in which the first outer shell part 10 and the second outer shell part 20 are coupled to each other such that their opening sides face in the same direction can be selected. Accordingly, the toy 1 can be easily transformed between the first form 1F, which is a sale form in which the toy 1 has a spherical shape, and the second form 2F, which is a display form. Further, since both the first outer shell part 10 and the second outer shell part 20 in the sale form can be used in the display form as well, the waste of parts can be eliminated.

Further, since the toy 1 according to the present embodiment can house the sub-part 70 inside the interior space SP in the first form 1F, the sub-part 70 can be provided together with the first outer shell part 10 and the second outer shell part 20 at the same time.

In the toy 1 according to the present embodiment, the coupling end of the second outer shell part 20 includes the first coupling portion 21*b* and the second coupling portion 22*b* whose coupling orientations with respect to the coupling end (opening edge 10*e*) of the first outer shell part 10 are different from each other. Accordingly, the first form 1F in which coupling is made using the first coupling portion 21*b* and the second form 2F in which coupling is made using the second coupling portion 22*b* can be provided.

In the toy 1 according to the present embodiment, the coupling end of the second outer shell part 20 includes the overhanging portion 21, which protrudes outwardly from the outer surface 20*us* along the opening edge 20*e* of the second outer shell part 20. Therefore, two opposing coupling portions can be provided on the respective front and back sides of the overhanging wall of the overhanging portion 21.

Further, since the coupling portions are provided on the respective front and back sides of the overhanging portion 21, inverting the second outer shell part 20 with respect to the first outer shell part 10 can easily switch the form of coupling between the first outer shell part 10 and the second outer shell part 20.

In the toy 1 according to the present embodiment, the opening edge 20*e* of the overhanging portion 21 constitutes a virtual plane. Therefore, in the display form (second form 2F), the overhanging portion 21 can function as the placement portion that is in contact with the placement surface 40. Further, in the display form (second form 2F), the first outer shell part 10 is mounted on the overhanging portion 21. In this state, the overhanging portion 21 functions as a portion that mounts and supports the first outer shell part 10.

When the toy 1 according to the present embodiment is in the display form (second form 2F), moreover, the second outer shell part 20 can be placed inside the first outer shell part 10. Since the second outer shell part 20 is stacked inside the first outer shell part 10, the second outer shell part 20 other than the coupling end of the second outer shell part 20 is not visible in the display form. Accordingly, any colors and design pattern can be used for the main body 20*a* of the second outer shell part 20 without caring about the display form.

In the toy 1 according to the present embodiment, the plurality of protrusions 21*d* is provided on the outer circumferential surface of the overhanging portion 21. In the second form 2F, which is the display state, therefore, the overhanging portion 21 has a decorative function. Further, when the first outer shell part 10 and the second outer shell part 20 are detached from each other or fitted together, the overhanging portion 21 functions as a non-slip portion (gripping portion) for a hand and fingers, thereby improving the handleability.

When the toy 1 according to the present embodiment is in the display form, the inner surface 10*is* of the first outer shell part 10 and the outer surface 20*us* of the second outer shell part 20 face each other. This double structure can, therefore, reinforce the strength even if the thickness of each of the first outer shell part 10 and the second outer shell part 20 is small. Moreover, the first outer shell part 10 and the second outer shell part 20 may be colored and have a light-transmitting property. In this case, if the first outer shell part 10 and the second outer shell part 20 have different colors, a composite color can be created by the colors of both of the first outer shell part 10 and the second outer shell part 20. Therefore, the color when the toy 1 is in the first form 1F can be differentiated from the color when the toy 1 is in the second form 2F.

When the toy 1 according to the present embodiment is in the second form 2F, the first outer shell part 10 and the second outer shell part 20 are closely arranged with a gap therebetween. This arrangement, for example, increases the insertable depth of the attachment protrusions 71*b* and 72*b*, which penetrate the first outer shell part 10.

Further, in the toy 1 according to the present embodiment, since the attachment protrusions 73*b* penetrate and are held by the first outer shell part 10 and the second outer shell part 20, the engagement regions (substantial length of engagement) that engage with the attachment protrusions 73*b* can be increased. Therefore, even if the main bodies of the first outer shell part 10 and the second outer shell part 20 are thin, the attachment protrusions 73*b* can be held and locked therein as if they were deeply inserted into a substantially thick material. For example, even if the ear parts 73 are large parts, they can be reliably held and fixed in the first outer shell part 10 and the second outer shell part 20.

When the toy 1 according to the present embodiment is in the second form 2F, moreover, the attachment protrusions 73*b* are engaged with both the first outer shell part 10 and the second outer shell part 20. Therefore, the attachment protrusions 73*b* can firmly fix the first outer shell part 10 and the second outer shell part 20.

In the toy 1 according to the present embodiment, the positioning portions 16 position the first outer shell part 10 and the second outer shell part 20 relative to each other in any of the coupling states between the first form 1F and the second form 2F. This facilitates the assembly into each form. Further, different fitting sizes of the recesses and protrusions in the positioning portions 16 help determine the orientation of coupling between the first outer shell part 10 and the second outer shell part 20 and guarantee accurate assembly.

The toy 1 according to the present embodiment can be assembled into the display state in which the sub-part 70 is attached to the hemispherical first outer shell part 10. In this state, the sub-part 70 appears to be attached to a cap-shaped hat. Further, since the display surface is hemispherical, the figure part 71 can be attached to a top portion thereof while the emblem part 72 is attached to the front side thereof. With this arrangement, the figure part 71, which is a character, and the emblem part 72, which is related to the character, can be arranged at the same time at the positions suitable for the display state. This enhances the quality and dignity of the display state of the character.

Second Embodiment

Hereinafter, a toy 1 according to a second embodiment of the present invention will be described with reference to FIGS. 11 to 18. In the present embodiment, identical or corresponding constituent components to those in the first embodiment will be given the same reference signs and the description thereof will be omitted as appropriate.

Figure 11:
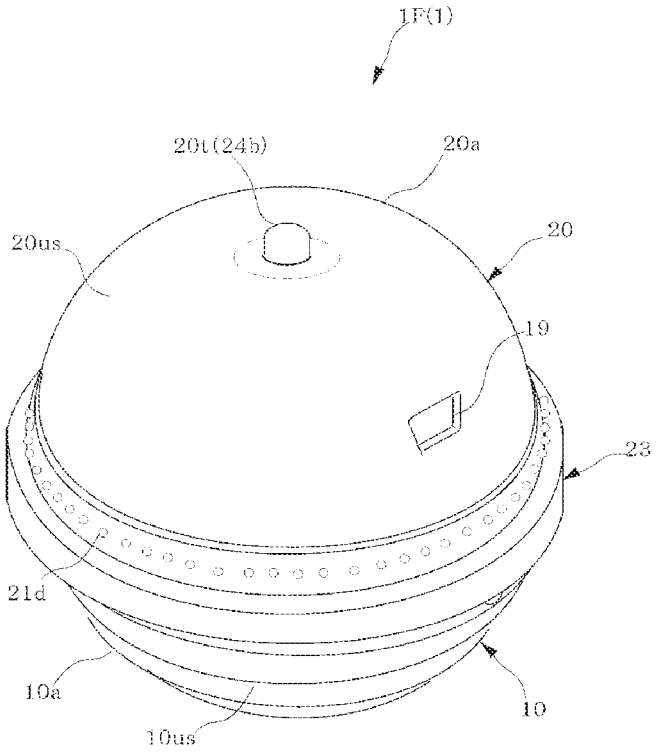
FIG. 11 is a perspective view illustrating a first form of a toy according to a second embodiment of the present invention.
Figure 12:
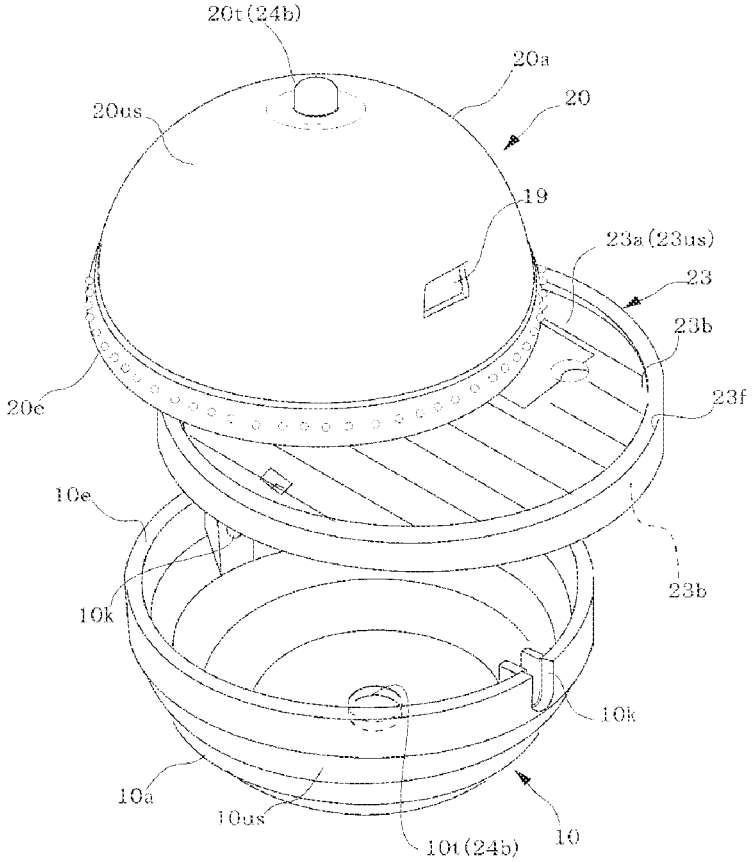
FIG. 12 is a perspective view illustrating the state in which the toy illustrated in FIG. 11 is disassembled.
Figure 13A:
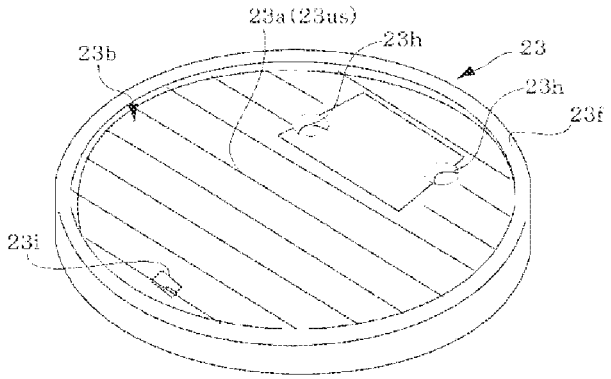
Figure 13B:
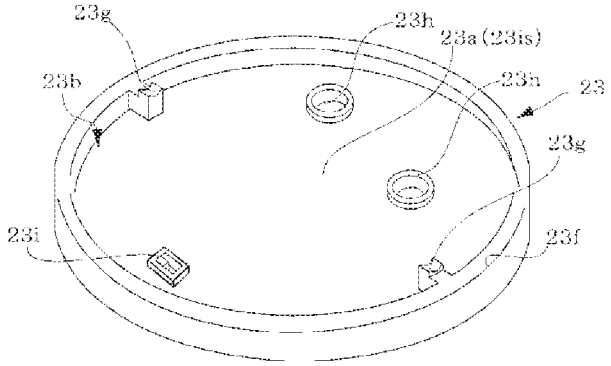
FIG. 13B is a perspective view illustrating the back surface side thereof.

FIG. 11 is a perspective view illustrating a first form 1F of the toy 1 according to the present embodiment. FIG. 12 is a perspective view illustrating the state in which the toy 1 illustrated in FIG. 11 is disassembled. FIGS. 13A and 13B are perspective views respectively illustrating the front and back surface sides of a third outer shell part 23. As illustrated in FIGS. 11 and 12, in the present embodiment, the toy 1 in the first form 1F includes hemispherical first and second outer shell parts 10 and 20 as with the first embodiment and further includes the third outer shell part 23 between the first outer shell part 10 and the second outer shell part 20. The third outer shell part 23 has, for example, a disk shape and includes third coupling portions 23*b*. One of the third coupling portions 23*b* is provided on the front surface of the third outer shell part 23 and can be coupled to an opening edge 20*e*, which is an end on one side (opening side) of the second outer shell part 20. The other third coupling portion 23*b* is provided on the back surface of the third outer shell part 23 and can be coupled to an opening edge 10*e*, which is an end on one side (opening side) of the first outer shell part 10. Therefore, the first outer shell part 10 and the second outer shell part 20 are coupled to each other via the third coupling portions 23*b*, thereby constituting the first form 1F.

As illustrated in FIGS. 13A and 13B, the third outer shell part 23 includes a disk-shaped, substantially flat, flat plate portion 23*a* and a flange portion 23*f* The flange portion 23*f* has a flange-like shape surrounding the outer periphery of the flat plate portion 23*a* and is thicker than the flat plate portion 23*a*. Further, each of the third coupling portions 23*b*, which are formed on the front and back sides of the third outer shell part 23, serves as a corner portion where the corresponding flange portion 23*f* and flat plate portion 23*a* meet. Specifically, in the first form 1F, as illustrated in FIG. 12, the third coupling portion 23*b* on a front side (23*us*) of the flat plate portion 23*a* is coupled to the second outer shell part 20, while the third coupling portion 23*b* on a back side (23*is*) of the flat plate portion 23*a* is coupled to the first outer shell part 10. Further, two circular holes 23*h* and one rectangular hole 23*i*, which penetrate the flat plate portion 23*a*, are provided in the third outer shell part 23. A pair of fitting protrusions 23*g* are provided on the back side (23*is*) of the flat plate portion 23*a* so as to protrude therefrom and hold paddle parts 75 to be described later. In both the first form 1F and a second form 2F, the fitting protrusions 23*g* are fitted into respective opening cut-outs 10*k*, which are formed in the opening edge 10*e* of the first outer shell part 10, so as to close the opening cut-outs 10*k* with part of the opening cut-outs 10*k* left unclosed (close only the upper ends of the opening cut-outs 10*k*).

In the second form 2F, the first outer shell part 10 and the second outer shell part 20 are coupled to each other such that an outer surface 10*us* of the first outer shell part 10 and an outer surface 20*us* of the second outer shell part 20 face each other (the opening sides face in opposite directions) as described later. For this coupling, for example, a protruding end 20*t*, which is an end on the other side of the second outer shell part 20, and a hole end 10*t*, which is an end on the other side of the first outer shell part 10, are provided as fourth coupling portions 24*b*. Therefore, the first outer shell part 10 and the second outer shell part 20 are coupled to each other via the fourth coupling portions 24*b*, thereby constituting the second form 2F. Further, as illustrated in FIG. 12, the first outer shell part 10 has the curved outer surface 10*us* with a step, while the second outer shell part 20 has the curved outer surface 20*us* without a step.

Figure 14:
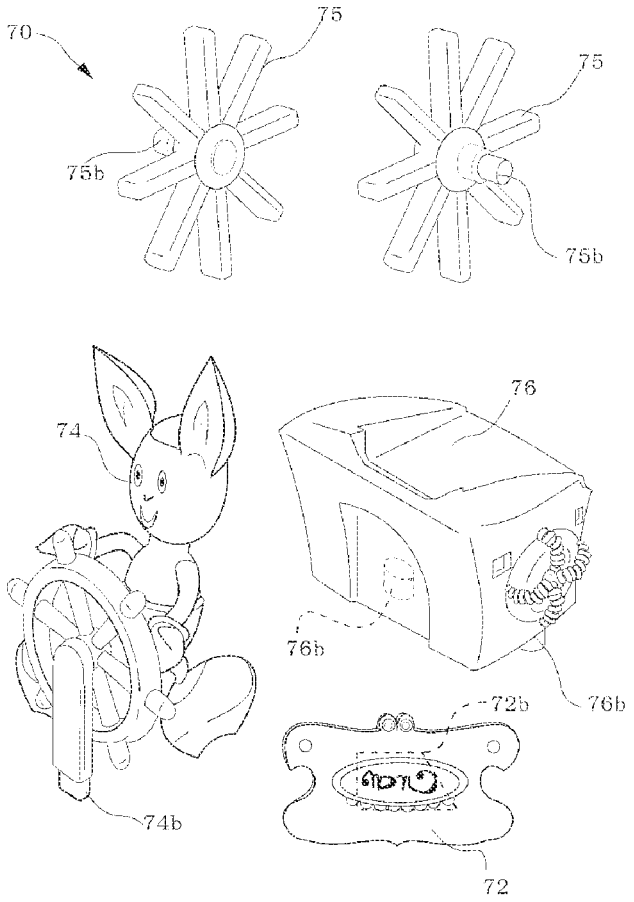
FIG. 14 is a perspective view illustrating an example of a sub-part according to the second embodiment.

FIG. 14 is a perspective view illustrating an example of a sub-part 70. In the second form 2F, the first outer shell part 10 is regarded as a side surface of a hull of a wooden steamship and the third outer shell part 23 is regarded as a deck on which a character can be placed. For example, the sub-part 70 according to the present embodiment includes a figure part 74, which is a sub-part of the fourth type, the pair of paddle parts 75, which are sub-parts of the fifth type, a cabin part 76, which is a sub-part of the sixth type, and the emblem part 72, which is the same as the one in the first embodiment. The figure part 74 integrally includes the figure part 71 according to the first embodiment and a rudder. The figure part 74 also includes a rectangular attachment protrusion 74*b*, which protrudes from the lower end of the rudder. Further, cylindrical attachment protrusions 76*b* are provided on the back surface of the cabin part 76. Further, each of the paddle parts 75 includes a paddle shaft 75*b*, which protrudes laterally from the center of the corresponding paddle part 75.

Figure 15:
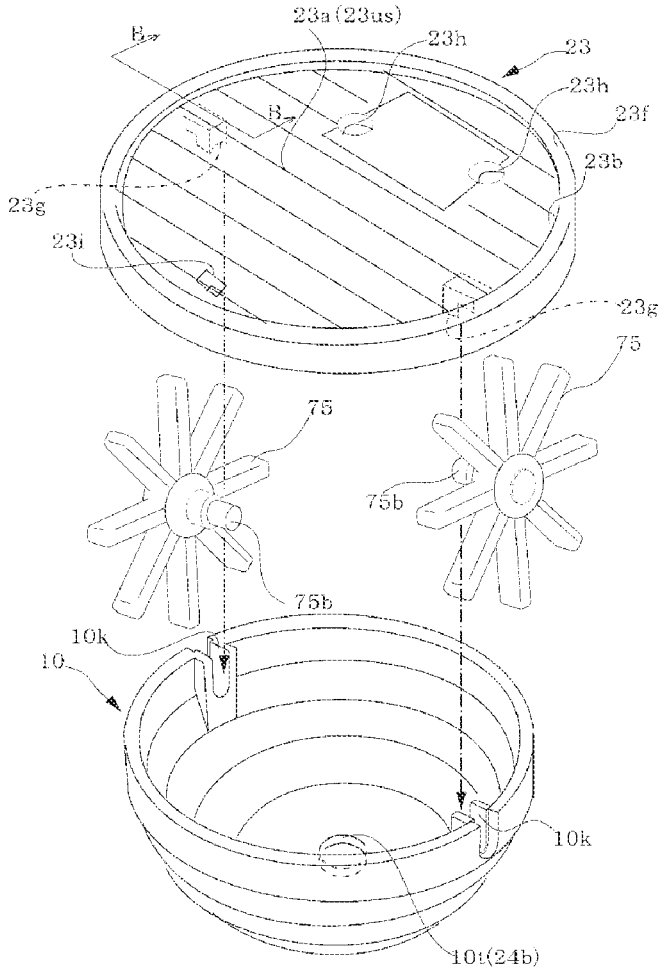
FIG. 15 is a perspective view illustrating how to attach sub-parts of the fifth type illustrated in FIG. 14.
Figure 16:
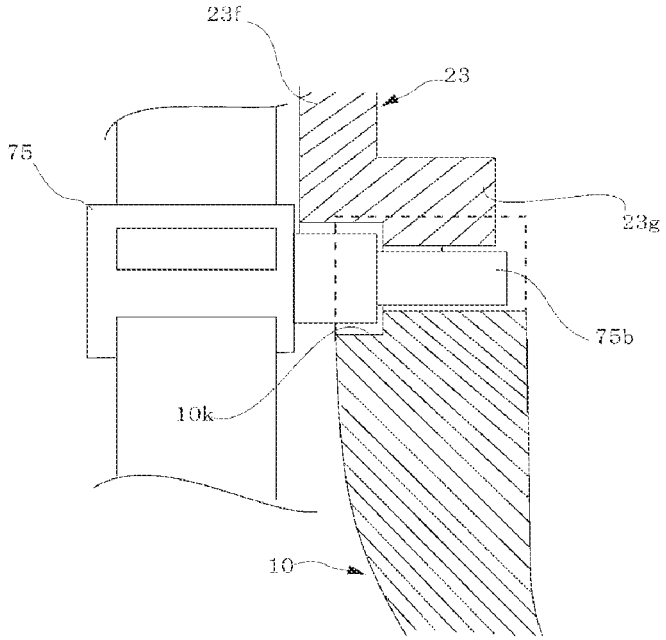
FIG. 16 is a sectional arrow view of a portion taken along line B-B of FIG. 15 in the state in which the sub-parts of the fifth type are attached.

The assembly of the toy 1 when transforming from the first form 1F into the second form 2F according to the present embodiment will be described with reference to FIGS. 15 to 18. FIG. 15 is a perspective view illustrating how to attach the sub-parts 75 of the fifth type illustrated in FIG. 14. FIG. 16 is a sectional arrow view of a portion taken along line B-B of FIG. 15 in the state in which the sub-parts 75 of the fifth type are attached.

As illustrated in FIG. 15, when the first outer shell part 10 and the third outer shell part 23 are attached to each other, the paddle shafts 75*b* of the paddle parts 75 are fitted into the respective opening cut-outs 10*k*. In this state, the fitting protrusions 23*g* are fitted into the respective opening cut-outs 10*k*. Accordingly, as illustrated in FIG. 16, each paddle shaft 75*b* is sandwiched and fixed by the corresponding fitting protrusion 23*g* and opening cut-out 10*k* from above and below. Further, fitting the fitting protrusions 23*g* fixes the first outer shell part 10 and the third outer shell part 23.

Figure 17:
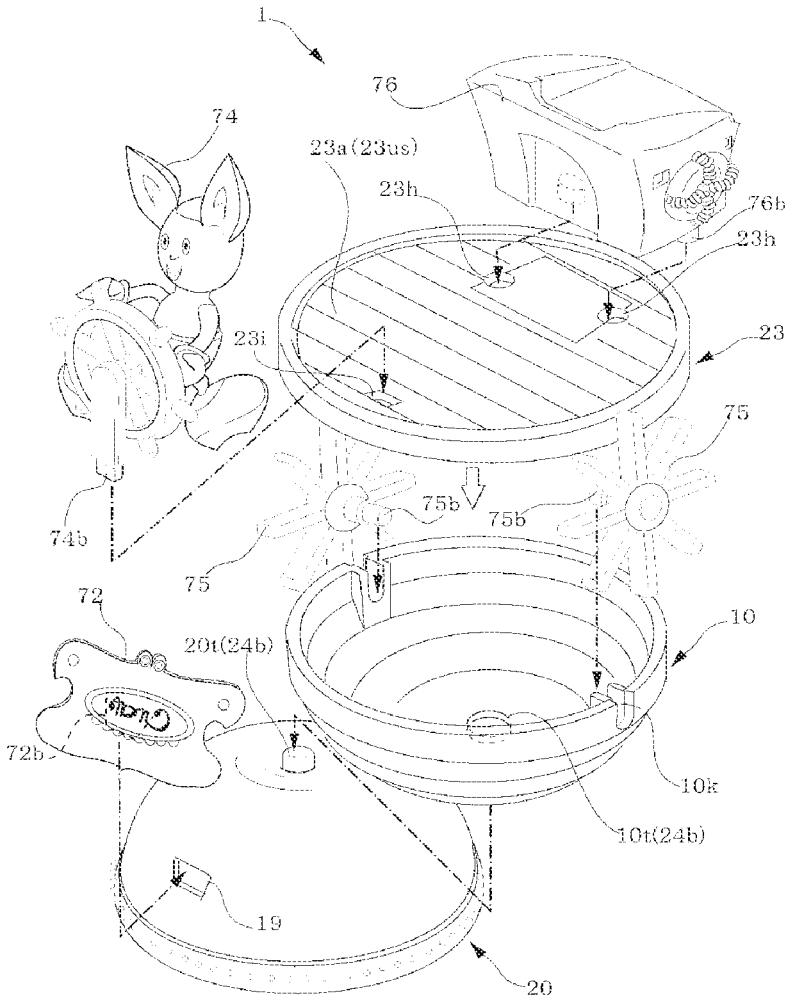
FIG. 17 is an exploded perspective view illustrating how to assemble sub-parts and the outer shell parts into a second form.
Figure 18:
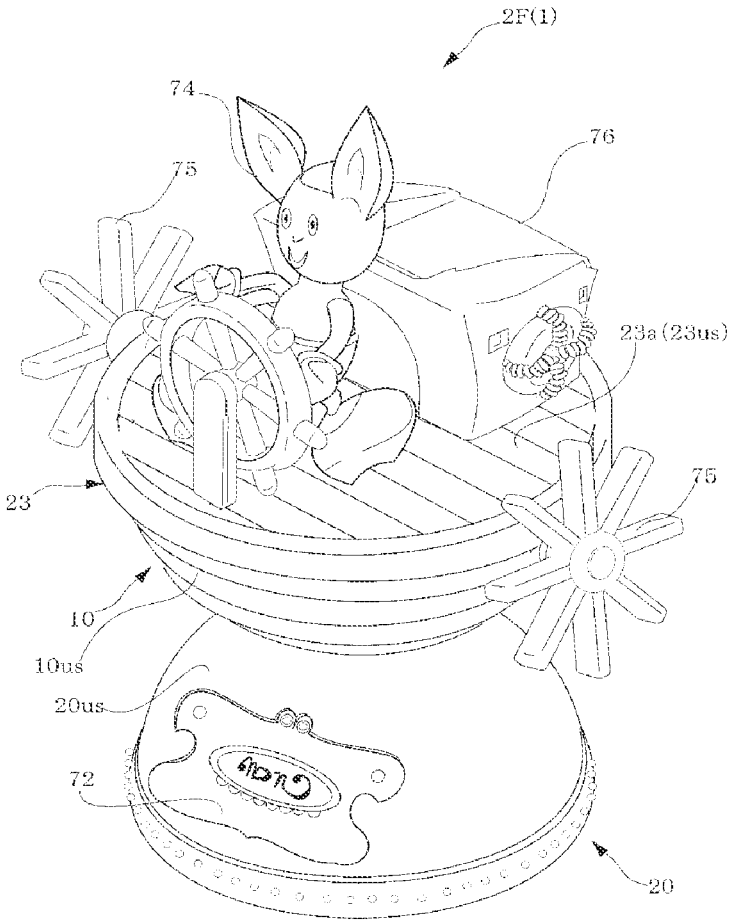
FIG. 18 is a perspective view illustrating the second form of the toy according to the second embodiment.

FIG. 17 is an exploded perspective view illustrating how to assemble the sub-parts and the first and second outer shell parts 10 and 20 into the second form 2F. FIG. 18 is a perspective view illustrating the second form 2F of the toy 1 according to the second embodiment. As illustrated in FIG. 17, the protruding end 20*t* of the second outer shell part 20 is fitted into the hole end 10*t* of the first outer shell part 10. Moreover, the figure part 74 is attached to the rectangular hole 23*i*, the emblem part 72 is attached to a trapezoidal hole 19, and the cabin part 76 is attached to the circular holes 23*h*. Accordingly, as illustrated in FIG. 18, the toy 1 is assembled into the display state in which the character is regarded as the captain of the steamship. As with the second form 2F of the first embodiment, the second outer shell part 20 functions as a placement portion configured to be placed on a placement surface in the second form 2F.

As described above, when the toy 1 according to the present embodiment is in the second form 2F, the first outer shell part 10 and the second outer shell part 20 are coupled to each other by the fourth coupling portions 24*b* such that their outer surfaces face each other. This increases the height of the display state.

In the toy 1 according to the present embodiment, the flat plate portion 23*a* of the third outer shell part 23 divides the interior space formed in the first form 1F. Accordingly, a plurality of housing spaces can be provided.

In the toy 1 according to the present embodiment, the flat plate portion 23*a* of the third outer shell part 23 makes the display surface for the sub-part 70 flat, making the area of the display large enough to facilitate the display in the second form 2F.

In the toy 1 according to the present embodiment, the paddle parts 75 (sub-part 70) can be attached by the combination of the fitting protrusions 23*g* of the third outer shell part 23 and the opening cut-outs 10*k* of the first outer shell part 10. Accordingly, the paddle parts 75 (sub-part 70), for example, can be attached to the side surface of the third outer shell part 23 instead of the flat surface of the third outer shell part 23. Further, fitting the fitting protrusions 23*g* into the opening cut-outs 10*k* fixes the third outer shell part 23 and the first outer shell part 10. Moreover, the way of attaching the paddle shafts 75*b* to the opening cut-outs 10*k* is not such that the paddle shafts 75*b* are pushed into holes. Therefore, even if the tip of each paddle shaft 75*b* has, for example, a large diameter, the paddle shafts 75*b* can be attached to the opening cut-outs 10*k*. As a result, it is also possible to employ a structure in which the paddle parts 75 are rotatably incorporated into the first outer shell part 10. Further, as with the first embodiment, in the first form 1F, the toy 1 is able to be supplied from a goods supply device, while in the second form 2F, the toy 1 is not able to be supplied from the goods supply device.

Although the embodiments of the present invention have been described above, the present invention can be modified as needed within the scope of the technical concept thereof. For example, although the positioning portions 16 perform positioning using the structure of two different sized recess and protrusion pairs in the first embodiment, the present invention is not limited to this configuration. For example, the size and shape of a pair of recess and protrusion may be changed.

What is claimed is:

1. A toy transformable between a first form and a second form, the toy comprising:

a first outer shell part, which forms a hemispherical shape; and a second outer shell part, which forms a hemispherical shape and is configured to be coupled to the first outer shell part, wherein at least a portion of an outer surface of the second outer shell part is sized to fit within an inner surface of the first outer shell part, the second outer shell part includes a main body having an opening formed therein and an overhanging portion formed along an opening edge of the main body, the overhanging portion protruding outward from the main body, the overhanging portion includes a first coupling portion and a second coupling portion, both of which are configured to be coupled with an edge of the first outer shell part, when the edge of the first outer shell part is coupled to the first coupling portion, the first form is formed, and when the edge of the first outer shell part is coupled to the second coupling portion, the second form is created, in the second form, the outer surface of the second outer shell part, excluding the overhanging portion, faces the inner surface of the first outer shell part, and the inner surface of the first outer shell part and the outer surface of the second outer shell part face each other, with a gap therebetween.

2. The toy according to claim 1, wherein the overhanging portion functions as a supporting portion configured to support the first outer shell part in the second form.

3. The toy according to claim 1, wherein the overhanging portion functions as a placement portion configured to be placed on a placement surface in the second form.

4. The toy according to claim 1, wherein a plurality of protrusions is formed on an outer circumferential surface of the overhanging portion.

5. The toy according to claim 1, wherein positioning portions are formed at the first outer shell part and those of the first coupling portion and the second coupling portion of the overhanging portion, and in a state in which the first outer shell part and the second outer shell part are coupled to each other, the positioning portions position the first outer shell part and the second outer shell part relative to each other for the coupling.

6. The toy according to claim 1, further comprising a sub-part configured to be coupled to the first outer shell part, wherein the sub-part is configured to be coupled to an outer surface of the first outer shell part.

7. The toy according to claim 6, wherein in the first form, the first outer shell part and the second outer shell part form a space thereinside, and the sub-part is configured to be housed in the space.

8. The toy according to claim 6, wherein the sub-part includes a sub-part of a first type and a sub-part of a second type, and the sub-part of the first type and the sub-part of the second type are configured to be coupled to different positions on the outer surface of the first outer shell part.

9. The toy according to claim 8, wherein the sub-part of the first type is a part having a shape of a character, and the sub-part of the second type is an emblem part.

10. The toy according to claim 6, wherein the sub-part further includes a sub-part of a third type, and the sub-part of the third type is configured to be coupled to the first outer shell part and the second outer shell part in the second form.

11. The toy according to claim 6, wherein in the first form, the toy is in a spherical shape and is able to be supplied from a goods supply device, and in the second form, the toy is in a display form in which the sub-part is able to be displayed.

* * * * *